US007574951B2

(12) United States Patent
Calvete Zumalde

(10) Patent No.: US 7,574,951 B2
(45) Date of Patent: Aug. 18, 2009

(54) SINGLE-SHOT RIFLE

(75) Inventor: Angel Calvete Zumalde, Zamudio (ES)

(73) Assignee: Ardesa S.A., Zamudio (ES)

( * ) Notice: Subject to any disclaimer, the term of this patent is extended or adjusted under 35 U.S.C. 154(b) by 0 days.

(21) Appl. No.: 11/876,659

(22) Filed: Oct. 22, 2007

(65) Prior Publication Data

US 2009/0100733 A1 Apr. 23, 2009

(51) Int. Cl.
*F41A 3/34* (2006.01)

(52) U.S. Cl. ..... 89/24; 42/23

(58) Field of Classification Search ..... 89/24; 42/23

See application file for complete search history.

(56) References Cited

U.S. PATENT DOCUMENTS 511,633 A 12/1893 Mason
592,239 A 10/1897 Davenport
617,110 A * 1/1899 Lynch ..... 89/24
3,355,833 A * 12/1967 Ruger et al. ..... 42/23
4,040,196 A * 8/1977 Smith et al. ..... 42/23
4,879,827 A * 11/1989 Gentry ..... 42/23

OTHER PUBLICATIONS

Partial European Search Report dated Apr. 11, 2008 in corresponding European Patent Application No. 07380285.

* cited by examiner

*Primary Examiner*—Stephen M Johnson
(74) *Attorney, Agent, or Firm*—Knobbe, Martens, Olson & Bear, LLP

(57) ABSTRACT

The invention relates to a single-shot rifle, comprising a receiver (1), a barrel (6) which is attached to the receiver (1), a bolt (8) housing a firing pin (24), located in correspondence with the back end of the barrel (6), wherein the bolt (8) and the back end of the barrel (6) are configured such that the bolt (8) can be coupled to the back end of the barrel (6) by means of a sliding movement in a direction perpendicular to the longitudinal direction, such that the bolt (8) can travel between a loading position in which it leaves the back end of the barrel (6) clear such that the user can introduce a bullet in a chamber of the barrel (6) through said back end of the barrel (6), and a firing position in which said chamber is locked by said bolt (8), the barrel (6) and the bolt (8) being attached by means of at least one rib (61) entering at least one channel (81).

19 Claims, 15 Drawing Sheets

A

B

SINGLE-SHOT RIFLE

OBJECT OF THE INVENTION

The present invention relates to a high-precision single-shot rifle, i.e. it allows a single shot per charge, the ammunition used having a metal casing, which can be applied in the arms industry, in which the unlocking and loading operations are performed manually by a lever, allowing quickly and easily changing the barrel of the rifle, which makes it easier to perform rifle maintenance and cleaning operations in addition to the great versatility this entails by allowing the use of different barrels and different calibers with the same rifle.

BACKGROUND OF THE INVENTION

In rifles existing today, the barrel is connected or fastened to the bolt by means of threading or other similar means preventing the user from being able to separate the barrel and the bolt, having to use the services of a gunsmith due to the complexity and specific tools required for the assembly and disassembly operations.

Some of the rifles mentioned in the preceding paragraph correspond to percussion rifles, such as, for example, the Sharps rifle, comprising mechanisms referred to as side-hammer or Sharps-Borchardt, or the rifle corresponding to the manufacturer Marlin, specifically the Ballard rifle model, as well as the coil spring-type Winchester rifle, such as the Low-wall Musket model.

Some of the drawbacks of these rifles include the fact that they do not allow quickly and easily changing the barrel, which is rather impractical since it does not enable using different calibers and barrel configurations, nor does it enable the user to easily disassemble the barrel for cleaning it.

Furthermore, given the connection between the barrel and the bolt in rifles existing today, these rifles often have very little precision as a result of the transmission of stress and strain to the rifle receiver.

Finally, occasionally, as a result of ammunition defects or overlapping, the firing pin perforates the primer when firing, causing a high-pressure backfire towards the shooter through the firing pin passage, specifically towards the shooter's face and eyes, with the subsequent risk of a serious accident that this entails.

DESCRIPTION OF THE INVENTION

The present invention relates to a single-shot rifle, having a metal cartridge, comprising a receiver; a longitudinally extending barrel having a front end and a back end, the barrel being attached to the receiver; a bolt housing a firing pin, the bolt being located in correspondence with the back end of the barrel.

According to the invention, the bolt and the back end of the barrel are configured such that the bolt can be coupled to the back end of the barrel by means of a sliding movement in a direction substantially perpendicular to the longitudinal direction, such that the bolt can travel, by means of said sliding movement, between a loading position in which it leaves the back end of the barrel clear such that a user can insert a cartridge in a chamber of the barrel through said back end of the barrel, and a firing position in which said chamber is locked by said bolt, the barrel and the bolt being attached by means of at least one rib entering at least one channel, such that said sliding movement is enabled and such that the bolt is prevented from traveling backwards with regard to the back end of the barrel.

An optimal contact surface for contact between bolt and barrel is thus provided. In addition, the attachment between bolt and barrel is obtained without involving the receiver, which represents a difference with regard to many conventional systems. The receiver therefore does not have to withstand the pressure and strain produced on the bolt at the moment of firing, from inside the chamber. This enables, for example, manufacturing the receiver with light alloy materials without reducing the strength of the assembly. In addition, it is very easy to disassemble the bolt with regard to the barrel, for example, for cleaning it, and it is also easy to later assemble the bolt.

The central supporting element of the rifle is the receiver, on which the barrel is borne, supported or held, which barrel, according to a preferred embodiment, is assembled to a solid element or part referred to as monobloc, with the cooperation of a cotter pin and a pair of anchoring screws attaching the solid element or monobloc to the receiver. The firing mechanisms and safety means, as well as the stock of the weapon, are also assembled in the receiver.

According to a preferred embodiment of the rifle of the invention, the fixing means comprise a cotter pin, for the purpose of assuring that the position of the barrel with regard to the receiver is always the same, also obtaining precise sliding between the bolt and the barrel.

A quick and easy assembly and disassembly of the barrel and the receiver is thus achieved, said receiver being the part which houses virtually all the mechanisms of the rifle, i.e. a metal part which is assembled in the barrel with the preferred cooperation of the cotter pin which is screwed to the receiver.

The bolt is arranged adjacent to the barrel, inside which the firing pin is housed, which firing pin is operated by a spring, in a back area of the bolt, i.e. in an area opposite to the barrel.

The stock is located in the back part of the rifle, behind the receiver, and it can have a wide variety of configurations and materials, which can be changed and combined with the rest of the elements of the rifle by means of connecting them to the receiver, for example, by means of a clamping screw.

Unlike currently existing rifle locking systems, which comprise a sliding block, the bolt of the rifle proposed by the invention has at least one channel configured to slide on the actual barrel, said bolt being firmly fastened to the barrel.

The possibility of the locking system having two or more rows of engaging channels and ribs is contemplated, although with a single row the locking system provides an optimal contact surface, several times greater than the contact surface for fastening said elements in any conventional rifle the bolt of which comprises traditional bolt lugs.

Furthermore, resulting from the connection or fastening between the barrel and the bolt being carried out without the cooperation of the receiver, maximum shot precision is obtained because an advantage of the rifle of the invention with regard to the sliding locking systems in rifles of the state of the art is that they do not transmit strain or stress to said receiver, which enables their manufacture with light alloys or materials without reducing the strength of the assembly and with the subsequent savings in weight and even the economic savings this entails.

The receiver, stock, lever and remaining mechanism assembly forms a module configured to be coupled or connected to barrels of different types, configurations and calibers, whereby providing a highly versatile rifle which enables its use, in a quick and easy manner, with barrels of different calibers.

It is contemplated that said at least one rib comprises at least one rib located at the back end of the barrel, and in which said at least one channel comprises at least one channel located in the bolt and configured to receive said at least one rib, such that with said at least one rib housed in said at least one channel the bolt is attached to the barrel such that it cannot travel backwards with regard to the barrel, but such that it can travel in a direction substantially perpendicular to the barrel, by means of sliding said at least one rib in said at least one channel.

According to a practical embodiment of the invention said at least one rib comprises at least two ribs, and said at least one channel comprises at least two channels.

It is also contemplated that said at least one rib extends around at least part of the circumference of the barrel, in correspondence with the back end of the barrel.

The rifle proposed by the invention comprises several sub-assemblies, some of which are modular, which enables quickly replacing them, as in the case of the stock or the barrel, for example.

It is contemplated that the barrel, in correspondence with its back part, is provided with a solid element, also referred to as monobloc, for fixing the barrel to the receiver. Said solid element preferably has holes for attaching the barrel and the receiver by means of screws, which are threaded in said holes.

In rifles of the state of the art, said solid element is traditionally fixed to the barrel by means of a recess at the back end of the barrel, for the purpose of introducing it in a longitudinal hole of said solid element. Both parts are fastened together by means of silver welding which occasionally fails either because of an incorrect application, due to the deterioration caused over time or due to the use of the weapon, causing serious drawbacks, such as the barrel flying off, with the subsequent risk of an accident, in addition to said silver welding requiring being applied in a very precise manner because otherwise there will be porosities which, upon bluing the barrel, allow the penetration of bluing salts which will ooze out, causing an unpleasant and dirty appearance.

To solve the drawback set forth in the preceding paragraph, the barrel of the rifle proposed by the invention is configured to be frontally introduced in the solid element. At the end close to the receiver, the barrel comprises at least one flange, close to the rib, used as a stop limiting the forward exit of the barrel with regard to the solid element. Said end of the barrel, which is configured to be in contact with the solid element, can be threaded or not.

Once the barrel is introduced in the solid element, and according to the threaded case, a strong glue or resin is introduced for the purpose of filling the gaps that may exist between the barrel and the solid element. Once the barrel is fixed to the solid element and the gaps are filled with the glue, the back end of the barrel is machined to obtain the ribs forming part of the fixing means for fixing the barrel to the bolt.

A quick and easy assembly and disassembly of the barrel and the receiver is thus achieved, said receiver being the part which houses virtually all the mechanisms of the rifle, i.e. a metal part which is assembled in the barrel with the preferred cooperation of the cotter pin, which is screwed to the receiver. To that end, the barrel fits into a channel existing for that purpose in the solid element or monobloc. The attachment between the receiver and the barrel is strengthened by means of the screws, such that by simply loosening said screws the barrel is easily separated from the receiver, which then enables separating the barrel from the bolt.

It is also contemplated that the rifle comprises a handguard, an element also known as a crossguard or crosstree, attached to the barrel by means of a pin threaded into the solid element and substantially extending parallel to the barrel, the pin having a substantially conical surface which is introduced in a clip in which the pin is held by means of a screw.

The handguard, also referred to as crosstree or crossguard, is located in the distal part of the rifle, i.e. in the part corresponding to the barrel, which is not fixed or fastened to the barrel, but rather is fixed to the solid element or monobloc by means of a pin which, at its end part, has a conical area configured to receive the action of a screw which is contained in the clip, which is in turn firmly fastened to the handguard.

It is contemplated as a possibility that the rifle comprises at least one lever pivotable about an axis, being said lever coupled to the bolt for its operation, such that when the lever pivots in a first direction, said lever moves the bolt towards the loading position, and when the lever pivots in un second direction opposite to the first direction, the lever moves the bolt towards the firing position.

For the purpose of allowing the unlocking and the locking of the bolt, the rifle comprises a lever configured to rotate with regard to an axis.

The lever has a latch that swings on an axis for its unlocking and its fixing, or immobilization, said latch being configured to engage in a pin fixed to the receiver for fixing the lever. To provide sufficient locking strength to this mechanism, the latch has a spring which at one end is fixed to the lever by means of a pin. In addition, the run of said latch is limited by another pin.

It is contemplated that the lever is coupled to the bolt by means of an attachment element pivotably coupled to the bolt and also pivotably coupled to the lever.

The lever is hingably connected to the bolt by means of an attachment element, which can consist of a chain or connecting rod, having two axes, on one hand an axis hinged to the bolt and on the other hand an axis hinged to the lever.

It is additionally contemplated that the lever is associated to an extractor configured for extracting the cartridge cases, such that when said lever pivots in said first direction, said lever makes said extractor slide backwards, so that it causes the extraction of a cartridge case.

According to a preferred embodiment, the lever is associated to said extractor by means of a pivotable arm, or extraction lever, meshing with the extractor and configured such that it follows the movement of the lever during at least part of the run of the lever between the loading position and the firing position of the bolt.

The pivotable arm is useful to transmit the movement of the lever to the extractor, such that the pivotable movement of the lever is converted into a linear movement of the extractor during part of the run of the lever.

In addition to the function of unlocking the bolt, the lever thus has other additional functions. The first of said additional functions consists of producing or causing the ejection or extraction of the fired ammunition cartridge cases from the chamber of the barrel. To that end, the lever has a bushing concentric to its axis configured to allow the rotation of the pivotable arm, also referred to as extraction lever, which is in turn configured to convert the rotational movement of the lever into a translational or sliding movement of the extractor.

The extraction system comprises a linear extractor located under the chamber of the rifle, said extractor being configured to mesh with the pivotable arm, in the same way a rack and pinion mechanism meshes.

When the user acts by lowering the unlocking lever, during the first part of its run it does not act on the pivotable arm. Then, when the bolt is located in a low enough position to allow the extraction, the contact or meshing between the lever and the pivotable arm occurs, which occurs by means of a small tooth said lever and said pivotable arm have such that they begin to rotate attached to one another.

The lever houses a part which, at the same time as that which is described above, receives the action or thrust of the spring, such that said part penetrates a small cavity located under the pivotable arm, achieving that the lever and the pivotable arm are temporarily attached or connected.

The rotational movement of the pivotable arm acts by making the extractor slide backwards, causing the extraction of the used ammunition metal casing or cartridge case which is housed in the barrel.

To relock the bolt and bring in the extractor, the user must simply lock the lever which is integral to the pivotable arm by means of the previously described part, which part pushes the extractor, and therefore the ammunition, inwardly.

Once the extractor reaches a stop position, if the lever continues to be rotated the temporary connection or attachment between the lever and the pivotable arm becomes undone, which the user can easily notice in the form of a small click or slight resistance to rotation. Then to completely lock the rifle, the user continues to rotate the lever until the bolt and the lever are completely locked.

The possibility that the extractor is provided with a cartridge case extraction pin is contemplated, which pin is housed in said extractor and is pressed on by a spring, said pin being configured to slide in a groove in the barrel during at least part of the run of the extractor, and to mesh with a used cartridge case for its extraction from the chamber.

The back part of the extractor has a pin acted or pressed on by the spring, engaging in an extraction groove of the back part of the used ammunition cartridge case.

According to a preferred embodiment of the invention, the rifle comprises a sear element pushed by a sear spring towards a position in which it engages a trigger, as well as a safety element that can travel between a position in which it prevents the firing of the rifle and another position in which it does not prevent the firing of the rifle, the safety element being drawn towards the position in which it prevents the firing of the rifle by a safety spring, the safety element and the sear element being arranged such that when the bolt travels towards the loading position, the sear element pushed by the sear spring is moved, allowing the safety element to travel to the position in which it prevents the firing of the rifle.

A second additional function of the lever is to automatically cock, activate or load the percussion means or system. To that end, when the bolt drops down, the sear element moves and drops down, acted on or driven by the sear spring. As a direct result of the foregoing, the safety element is released and automatically flies out backwards due to the effect or the actuation of the safety spring, the action of which is opposite to the action of the sear spring, such that the rifle is in a safety or locked position.

The safety element, which can consist of a knurled lever, is located on the receiver of the rifle in an easy access position for the thumb of the hand the user is firing with, enabling ambidextrous use.

Said safety element is configured to be placed, or activated, and removed, or deactivated, by the user, having the particularity that said safety element is always automatically located in the active position when the bolt is unlocked to load or unload the weapon, preventing in said active safety position the firing of the rifle.

For the rifle to meet optimal conditions, it is necessary to arrange said safety element, since the rifle automatically charges the hammer when the lever moves up. To that end, the safety element has a safety spring which pulls on said safety element as soon as the sear element is released from the hammer, i.e. when the lever is lowered. Therefore, when said lever moves up, for the purpose of compressing the percussion spring, the safety element is already acting, i.e. it is already activated. In short, in order to fire it is always necessary for the user to voluntarily remove the safety, placing it in the inactive position.

According to a preferred embodiment, the rifle comprises a highly sensitive trigger provided with dual-regulation. To that end, the trigger has, in its lower part, an adjusting screw which, by means of tightening it, achieves that the trigger recoils, therefore the engagement of the upper area with the sear element is reduced, and therefore the trigger is attenuated.

Once the firing has been performed, the rifle has the end stop adjusting screw, which runs inside the trigger spring, which decreases or reduces the run of the trigger by means of tightening it.

It is also contemplated that the sear element is arranged such that when the bolt travels towards its loading position, the sear element engages with the trigger.

The possibility that the rifle comprises a hammer configured to strike the firing pin when the trigger is squeezed with the safety element in the position in which it does not prevent the firing of the rifle is contemplated, the hammer being pivotably attached to the bolt such that it travels with the bolt when the bolt travels between the firing position and the loading position.

When the sear element drops down, it contacts or engages with the trigger. When the bolt is raised, the hammer contained in said bolt is retained by the sear element, the rifled being in a cocked position.

The hammer is located inside the bolt and is configured to strike the firing pin, such that said firing pin in turn acts on an ammunition percussion cap causing its detonation.

The possibility that the hammer is linked to the sear element such that is retained by the sear element when the bolt travels from the loading position towards the firing position is contemplated, such that when the bolt reaches the firing position, the hammer is cocked to be fired towards the firing pin.

The single-shot rifle of the invention can also comprise a fire protection element, associated to the bolt and configured to impede a possible backfire from injuring the user.

The bolt is locked with the fire protection element, also referred to as a safety deflector, which consists of a steel part which is fastened to the bolt by a screw. The lower part of the bolt has the hammer, which is configured to rotate with regard to a hammer axis and be acted on by a main spring.

Occasionally, as a result of ammunition defects or overlapping, the firing pin perforates the primer when firing, causing a high-pressure backfire towards the shooter through the firing pin passage, specifically towards the shooter's face and eyes, with the subsequent risk of a serious accident that this entails.

For the purpose of increasing the safety of the rifle, by means of eliminating the effect described in the preceding paragraph, the rifle proposed by the invention comprises a fire protection element, i.e. a safety deflector consisting of a steel part firmly fastened to the bolt, said fire protection element being configured to deflect the backfire occurring when firing towards inner areas, with lower exhaust, of the receiver, making said bolt lose pressure and thus preventing the previously discussed accidents.

According to a preferred embodiment of the invention, the fire protection element comprises a deflection surface, configured to deflect sparks into the receiver, preventing them from reaching the user's eyes. Said deflection surface is preferably configured such that it forms, in the vertical plane traversing the barrel when the rifle is in a conventional use position, an angle of approximately 45 degrees with the longitudinal direction in which the barrel extends.

To that end the fire protection element comprises an inclined plane, preferably occupying a 45° inclination when the rifle is in a firing position, which is located opposite to the passage of the firing pin, such that by means of this arrangement the sparks bounce off and are guided downwards, avoiding striking the face of the user of the rifle.

Therefore, according to the described invention, the single-shot rifle proposed by the invention is an advance in rifles used up until now, and it solves in a fully satisfactory manner the drawbacks set forth above insofar as it allows carrying out in a simple manner the disassembly and assembly operations of the barrel and the bolt, all this with a rifle that does not transmit stress to the receiver, considerably increasing shot precision.

DESCRIPTION OF THE DRAWINGS

To complement the description being made and for the purpose of aiding to better understand the features of the invention according to a preferred practical embodiment thereof, a set of drawings is attached as an integral part of said description which, with an illustrative and non-limiting character, show the following.

PREFERRED EMBODIMENT OF THE INVENTION

Figure 1:
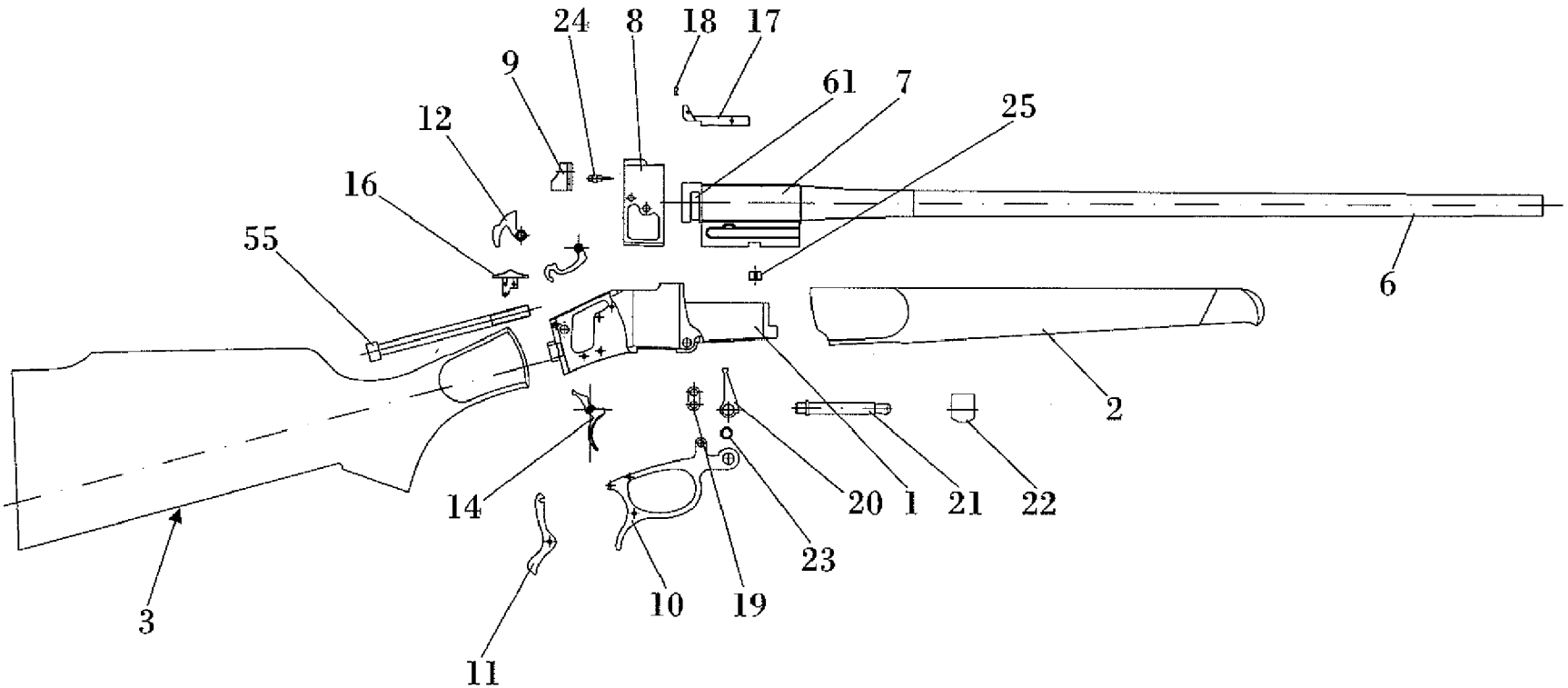
FIG. 1 shows an exploded plan view of the rifle proposed by the invention.

In view of the discussed figures, it can be seen how in one of the possible embodiments of the invention, the single-shot rifle proposed by the invention comprises a receiver (1) and a longitudinally extending barrel (6) and having a front end and a back end, said barrel (6) being attached to the receiver (1).

In addition, the rifle comprises a bolt (8) housing a firing pin (24), the bolt (8) being located in correspondence with the back end of the barrel (6).

According to the invention, the bolt (8) and the back end of the barrel (6) are configured such that the bolt (8) can be coupled to the back end of the barrel (6) by means of a sliding movement in a direction substantially perpendicular to the longitudinal direction, such that the bolt (8) can travel, by means of said sliding movement, between a loading position in which it leaves the back end of the barrel (6) clear such that a user can insert a cartridge in a chamber of the barrel (6) through said back end of the barrel (6), and a firing position in which said chamber is locked by said bolt (8), the barrel (6) and the bolt (8) being attached by means of at least one rib (61) entering at least one channel (81), such that said sliding movement is enabled and such that the bolt (8) is prevented from traveling backwards with regard to the back end of the barrel (6).

The central supporting element of the rifle is the receiver (1), on which the barrel (6) is borne, supported or held by means of a cotter pin (25) fastened with a screw (35). This arrangement also allows fixing the end part of the barrel (6), as can be seen in any of FIGS. 2 to 10.

Said figures show a preferred embodiment of the rifle of the invention, in which the fixing means comprising said cotter pin (25), for the purpose of assuring that the position of the barrel (6) with regard to the receiver (1) is always the same, also obtaining precise sliding between the bolt (8) and the barrel (6), can be seen.

Located adjacent to the barrel (6) is the bolt (8), inside which the firing pin (24), which is operated by a spring (27), is housed, in a back area of the bolt (8), i.e. in an area opposite to the barrel (6).

The stock (3) is located in the back part of the rifle, behind the receiver (1), and it can have a wide variety of configurations and materials, which can be changed and combined with the rest of the elements of the rifle by means of connecting them to the receiver (1), for example, by means of a clamping screw (55).

Figure 11:
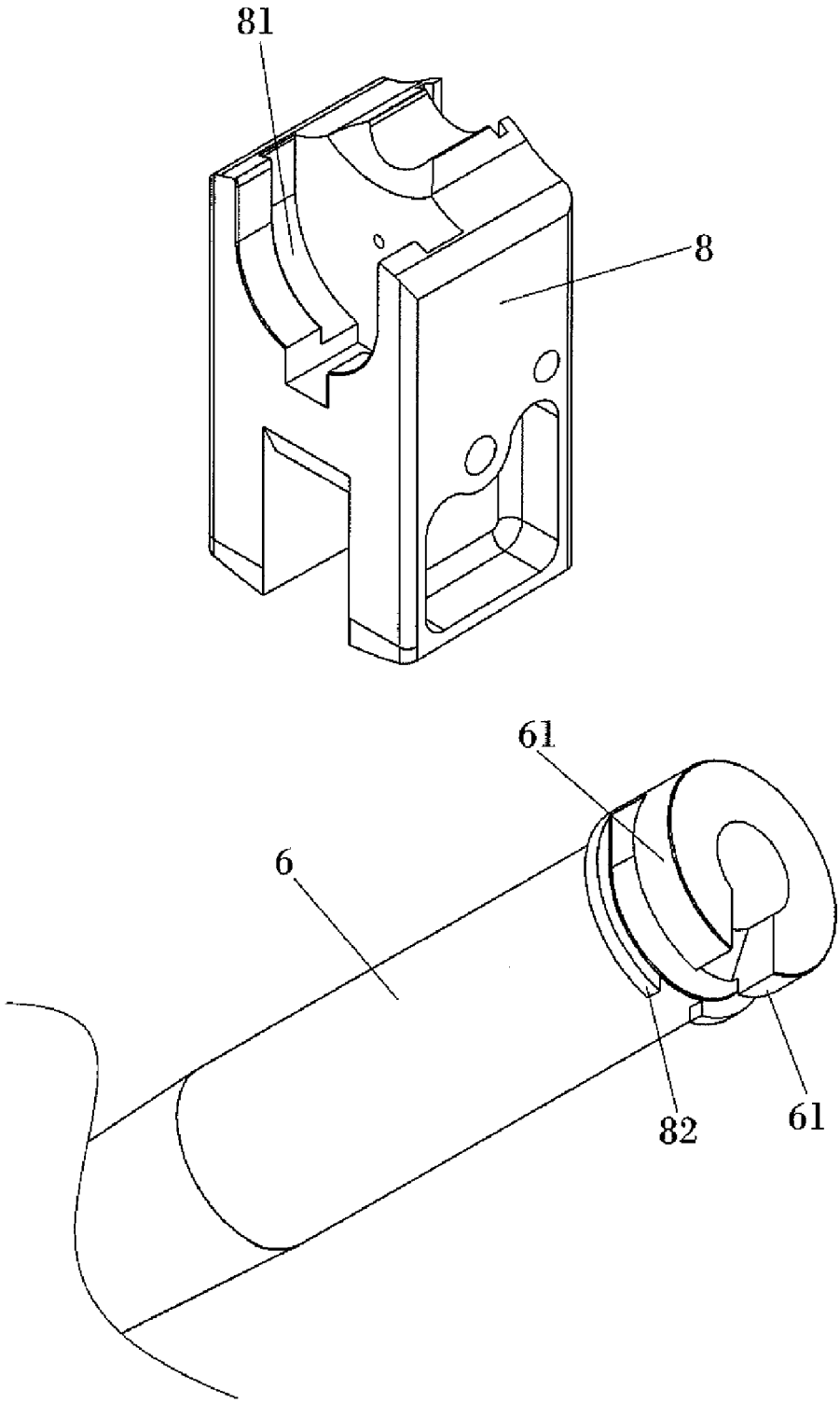
FIG. 11 shows a partial perspective view of the barrel and the bolt according to an embodiment in which the barrel has a fixing rib and the bolt has a channel to house said rib of the barrel.
Figure 12:
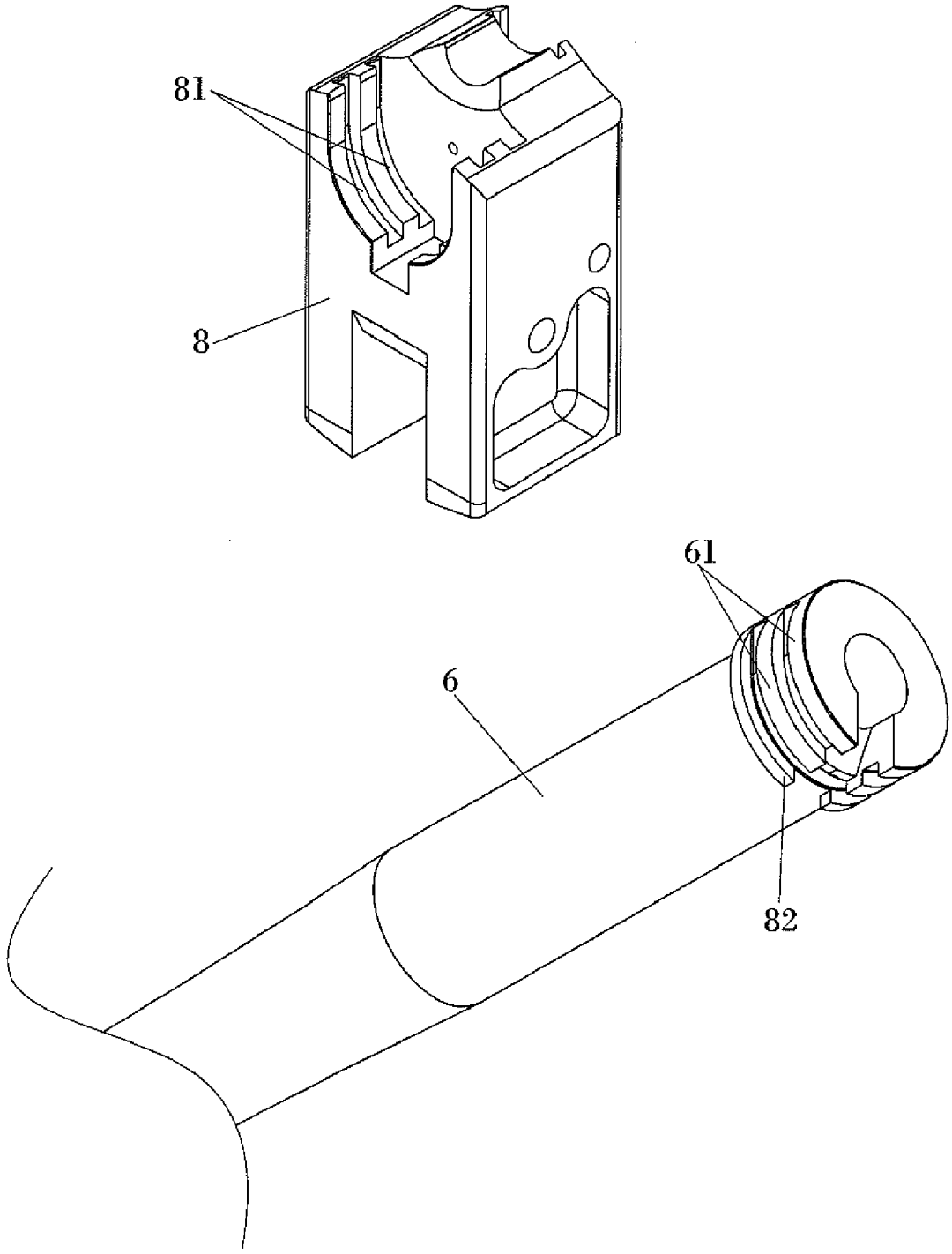
FIG. 12 shows a partial perspective view of the barrel and the bolt according to an embodiment in which the barrel has two fixing ribs and the bolt has two channels.
Figure 13:
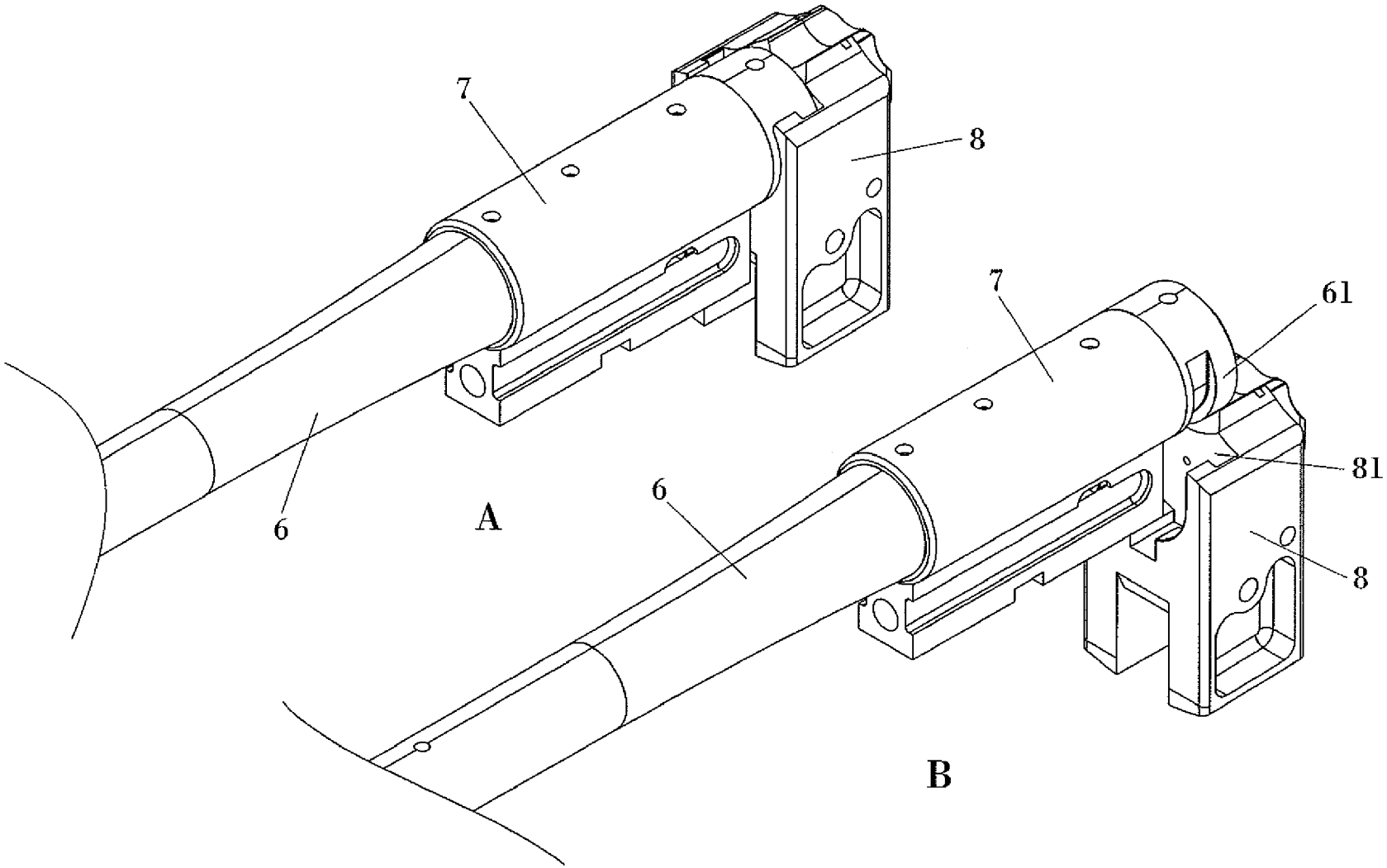
FIG. 13 shows two perspective views A and B in which the barrel and the bolt can be seen in an assembly position and in a disassembly position respectively.
Figure 14:
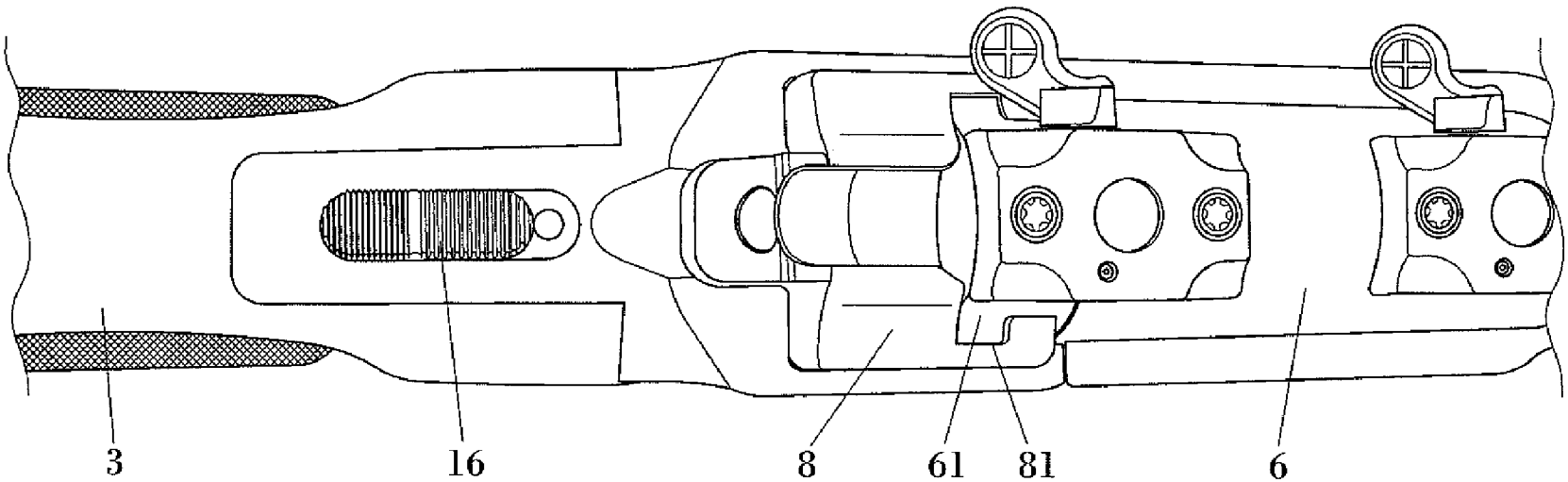
FIG. 14 shows a plan view, from a zenithal point of view, of the area corresponding to the action mechanisms of the rifle, in which the connection between the bolt and the barrel can be seen.

The locking means, or locking system, of the rifle of the invention are depicted in FIGS. 11 and 12. The bolt (8) of the rifle proposed by the invention has at least one channel (81) configured to slide on the actual barrel (6), said bolt (8) being firmly fastened to the barrel (6).

FIG. 12 shows an embodiment variant in which the locking system has two more rows of engaging channels (81) and ribs (61).

FIG. 11 shows a preferred embodiment comprising a rib (61) located in the back end of the barrel (6) and a channel (81) located in the bolt (8) and configured to receive said rib (61), such that with said rib (61) housed in said channel (81) the bolt (8) is attached to the barrel (6) such that it cannot travel backwards with regard to the barrel (6), but such that it can travel in a direction substantially perpendicular to the barrel (6), by means of sliding said rib (61) in said channel (81).

Said rib (61) also extends around at least part of the circumference of the barrel (6), in correspondence with the back end of the barrel (6).

In correspondence with its back part, the barrel (6) is provided with a solid element (7), also referred to as monobloc, for fixing the barrel (6) to the receiver (1).

Figure 15:
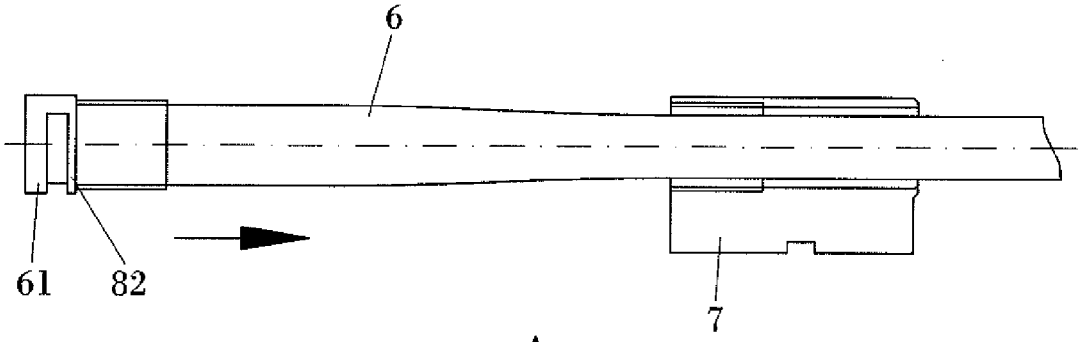
FIG. 15 shows two elevational views of an assembly sequence between the barrel and the solid element or monobloc, the solid element being sectioned in view A so as to better see the introduction sequence, whereas in view B said elements are shown in the coupling or assembly situation, the position being limited by a recess in the barrel.
Figure 15:
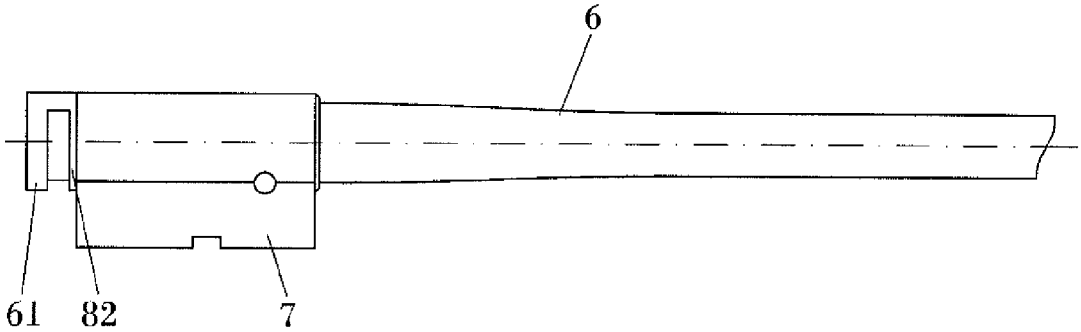

As can be seen in views A and B of FIG. 15, the barrel (6) is configured to be frontally introduced in the solid element (7). In the end close to the receiver (1), the barrel (6) comprises a flange (82), close to the rib (61), used as a stop limiting the forward exit of the barrel (6) with regard to the solid element (7).

Once the barrel (6) is introduced in the solid element (7), glue or resin is introduced for the purpose of filling the gaps that may exist between the barrel (6) and the solid element (7).

Said solid element (7) preferably has holes for the attachment between the barrel (6) and the receiver (1) by means of screws (33), which are threaded in said holes.

A quick and easy assembly and disassembly of the barrel (6) and the receiver (1) is thus obtained, said receiver (1) being the part housing virtually all the mechanisms of the rifle, i.e. a metal part assembled in the barrel (6) with the preferred cooperation of the cotter pin (25), which is screwed to the receiver (1). To that end the barrel (6) fits into a channel existing for that purpose in the solid element (7). The attachment between the receiver (1) and the barrel (6) is strengthened by means of the screws (33), such that by simply loosening said screws (33) the barrel (6) is easily separated from the receiver (1), which allows then separating the barrel (6) from the bolt (8).

The rifle comprises a handguard (2) attached to the barrel (6) by means of a pin (21) threaded in the solid element (7) and substantially extending parallel to the barrel (6), the pin (21) having a substantially conical surface which is introduced in a clip (22) in which the pin (21) is held by means of a screw (53).

Figure 10:
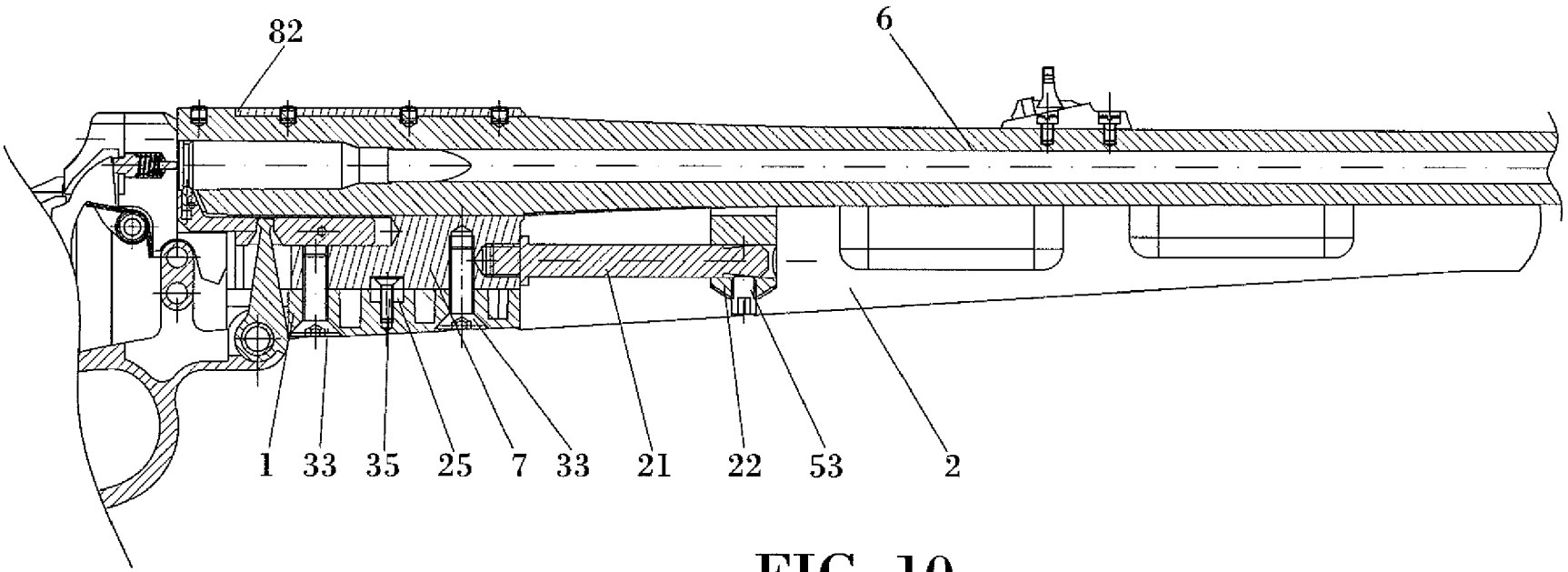
FIG. 10 shows a longitudinal section of the rifle, in which the front binding system can be seen.

As can be seen in FIG. 10, the handguard (2), also referred to as crosstree or crossguard, is located in the distal part of the rifle, i.e. in the part corresponding to the barrel (6), which is not fixed or fastened to the barrel (6), but rather is fixed to the solid element (7) by means of a pin (21) which, at its end part, has a conical area configured to receive the action of a screw (53) which is contained in the clip (22), which is in turn firmly fastened to the handguard (2).

The rifle comprises a lever (10) pivotable about an axis (38), said lever (10) being coupled to the bolt (8) for its operation, such that when the lever (10) pivots in a first direction, said lever (10) moves the bolt (8) towards the loading position, and when the lever (10) pivots in a second direction opposite to the first direction, the lever (10) moves the bolt (8) towards the firing position.

The lever (10) has a latch (11) that swings on an axis (39) for its unlocking and its fixing, or immobilization, said latch (11) being configured to engage in a pin (45) fixed to the receiver (1) for fixing the lever (10). To provide sufficient locking strength to this mechanism, the latch (11) has a spring (31) which at one end is fixed to the lever (10) by means of a pin (40). In addition, the run of said latch (11) is limited by another pin (52), as has been shown, for example, in FIG. 4.

The lever (10) is coupled to the bolt (8) by means of an attachment element (19) pivotably coupled to the bolt (8) and also pivotably coupled to the lever (10).

The lever (10) is hingably connected to the bolt (8) by means of an attachment element (19), consisting of a chain or connecting rod having two axes, on one hand an axis (36) hinged to the bolt (8) and on the other hand an axis (37) hinged to the lever (10).

In addition, the lever (10) is associated to an extractor (17) configured for extracting the cartridge cases, such that when said lever (10) pivots in said first direction, said lever (10) makes said extractor slide backwards (17), so that it causes the extraction of a cartridge case.

According to a preferred embodiment, the lever (10) is associated to said extractor (17) by means of a pivotable arm (20), or extraction lever, engaging with the extractor (17) and being configured such that it follows the movement of the lever (10) during at least part of the run of the lever (10) between the loading position and the firing position of the bolt (8).

The pivotable arm (20) is useful to transmit the movement of the lever (10) to the extractor (17), such that the pivotable movement of the lever (10) is converted into a linear movement of the extractor (17), during part of the run of the lever (10)

In addition to the function of unlocking the bolt (8), the lever (10) thus has other additional functions. The first of said additional functions consists of producing or causing the ejection or extraction of the fired ammunition cartridge cases from the chamber of the barrel (6). To that end, the lever (10) has a bushing (23) concentric to its axis (38) configured to allow the rotation of the pivotable arm (20), also referred to as extraction lever, which is in turn configured to convert the rotational movement of the lever (10) into a translational or sliding movement of the extractor (17).

The extraction system comprises a linear extractor (17) located under the chamber of the rifle, said extractor (17) being configured to mesh with the pivotable arm (20), in the same way a rack and pinion mechanism meshes.

When the user acts by lowering the unlocking lever (10), during the first part of its run it does not act on the pivotable arm (20). Then, when the bolt (8) is located in a low enough position to allow the extraction, the contact or meshing between the lever (10) and the pivotable arm (20) occurs by means of a small tooth said lever (10) and said pivotable arm (20) have such that they begin to rotate attached to one another.

The lever (10) houses a part (58) which, at the same time as that which is described above, receives the action or thrust of the spring (57), such that said part (58) penetrates a small cavity located under the pivotable arm (20), achieving that the lever (10) and the pivotable arm (20) are temporarily attached or connected.

The rotational movement of the pivotable arm (20) acts by making the extractor (17) slide backwards, causing the extraction of the used ammunition metal casing or cartridge case which is housed in the barrel (6).

To relock the bolt (8) and bring in the extractor (17), the user must simply lock the lever (10) which is integral to the pivotable arm (20) by means of the previously described part (58), which part (58) pushes the extractor (17), and therefore the ammunition, inwardly.

Once the extractor (17) reaches a stop position, if the lever continues to be rotated (10) the temporary connection or attachment between the lever (10) and the pivotable arm (20) becomes undone, which the user can easily notice in the form of a small click or slight resistance to rotation. Then to completely lock the rifle, the user continues to rotate the lever (10) until the bolt (8) and the lever (10) are completely locked, as shown in FIGS. 2 to 7.

In addition, the extractor (17) is provided with a cartridge case extraction pin (18), which is housed in said extractor (17) and is pressed on by a spring (56), said pin (18) being configured to slide in a groove in the barrel (6) during at least part of the run of the extractor (17) and to mesh with a used cartridge case for its extraction from the chamber.

Figure 6:
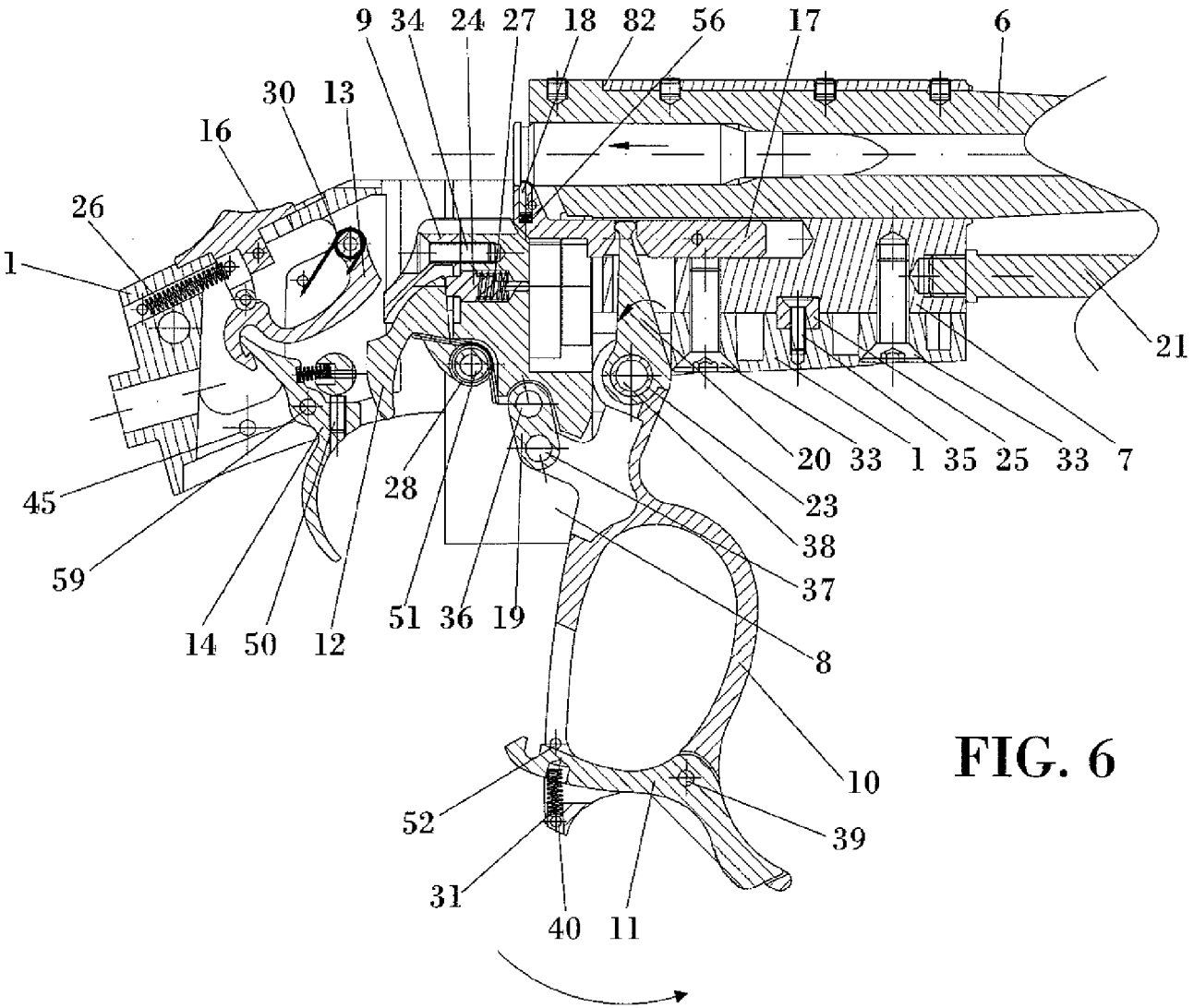
FIG. 6 shows a longitudinal section of the action mechanism of the rifle in a second extraction position.
Figure 7:
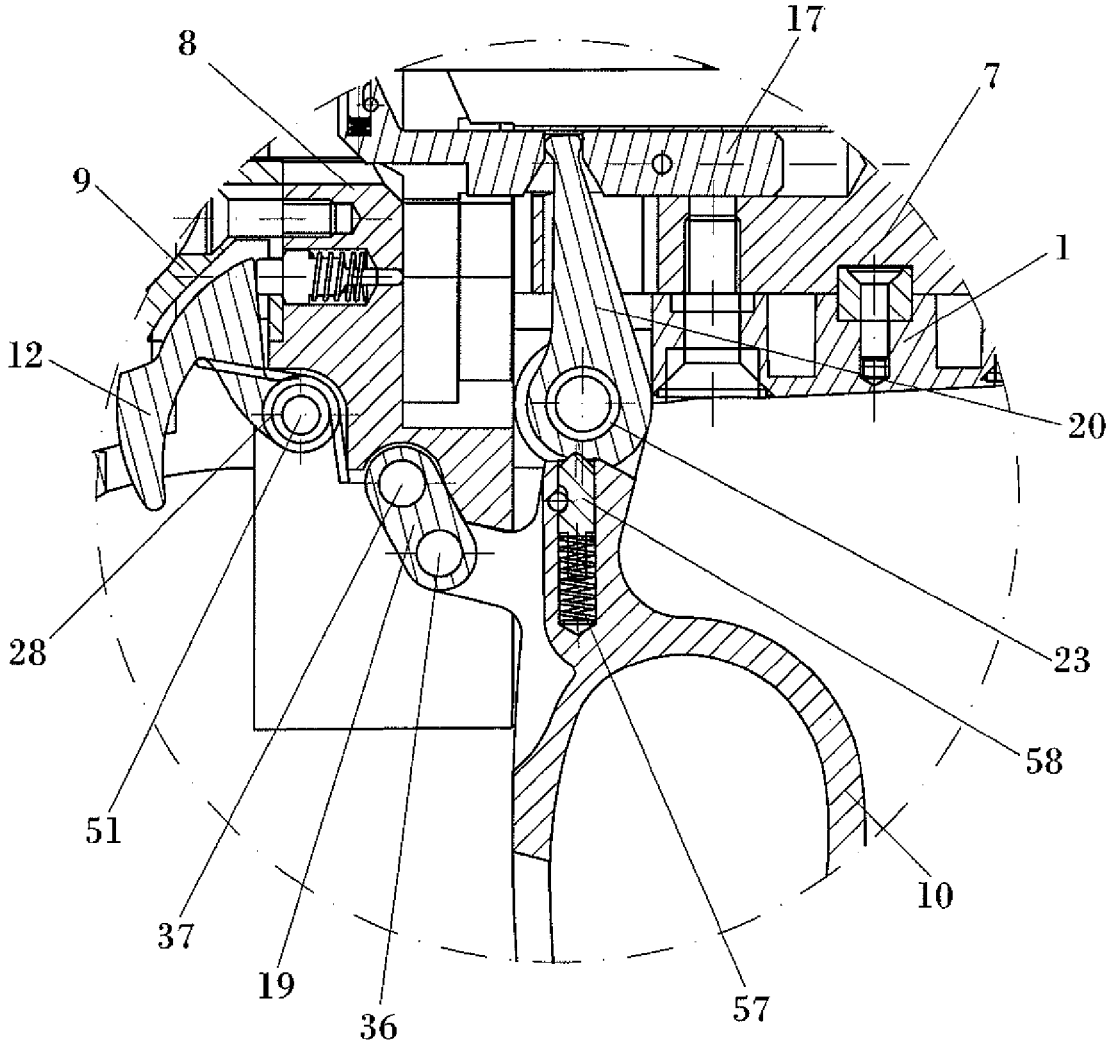
FIG. 7 shows un detail of the previous figure corresponding to the lever and the pivotable arm.

As can be seen in FIG. 6, the back part of said extractor (17) has a pin (18) acted or pressed on by the spring (56), engaging in an extraction groove of the back part of the used ammunition cartridge case.

According to a preferred embodiment of the invention, the rifle comprises a sear element (13) pushed by a sear spring (30) towards a position in which it engages a trigger (14), as well as a safety element (16) that can travel between a position in which it prevents the firing of the rifle and another position in which it does not prevent the firing of the rifle, the safety element (16) being drawn towards the position in which it prevents the firing of the rifle by a safety spring (26), the safety element (16) and the sear element (13) being arranged such that when the bolt (8) travels towards the loading position, the sear element (13) pushed by the sear spring (30) is moved, is moved, allowing the safety element (16) to travel to the position in which it prevents the firing of the rifle.

Figure 8:
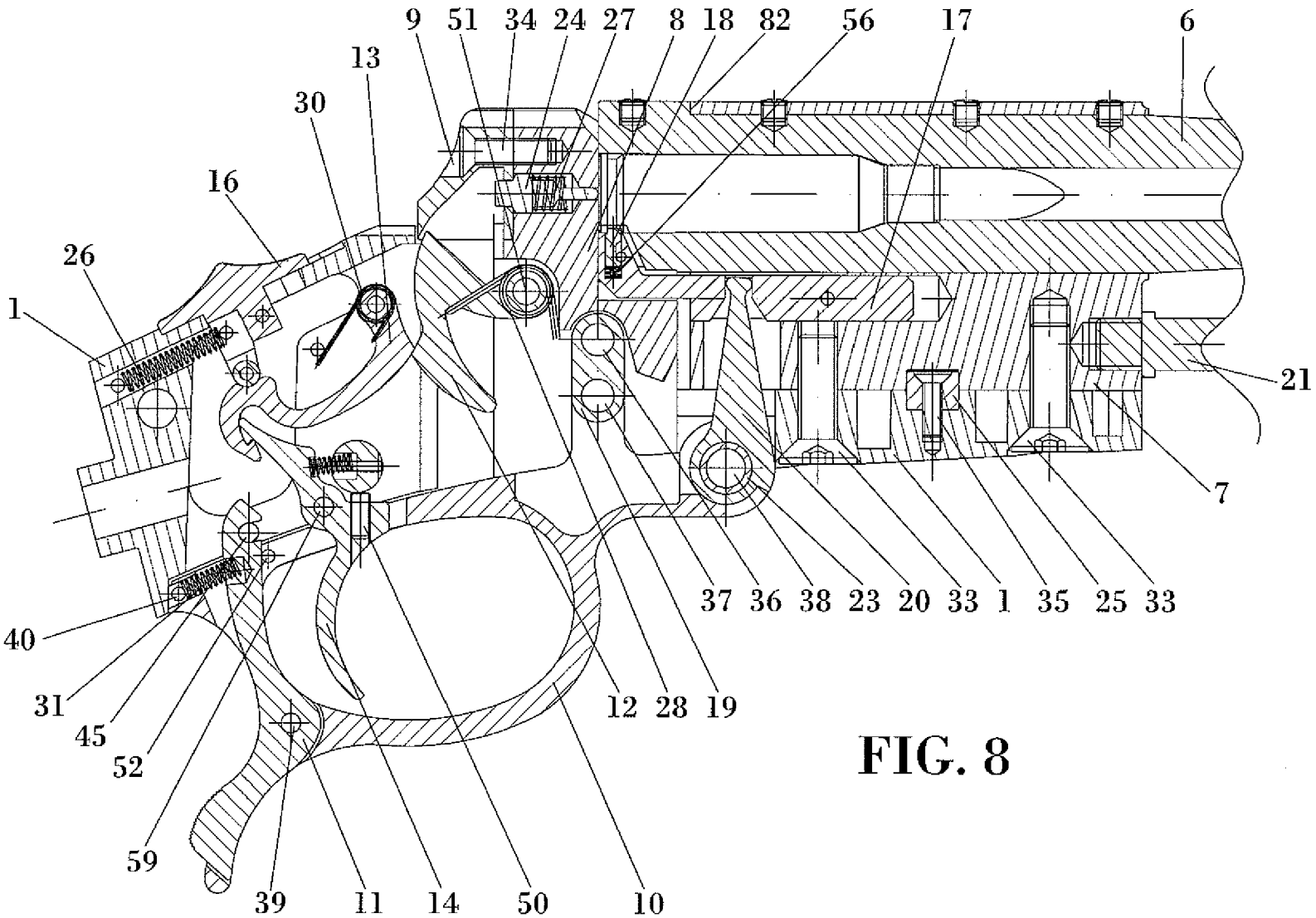
FIG. 8 shows a longitudinal section of the action mechanism of the rifle in an assembled position in which the safety is active.

A second additional function of the lever (10) is to automatically cock, activate or load the percussion means or system. To that end, when the bolt (8) drops down, the sear element (13) moves and drops down, acted on or driven by the sear spring (30). As a direct result of the foregoing, the safety element (16) is released and automatically flies out backwards due to the effect or the actuation of the safety spring (26), the action of which is opposite to the action of the sear spring (30), such that the rifle is in a safety or locked position, position which is shown in FIG. 8.

The safety element (16) is located on the receiver (1) of the rifle in an easy access position for the thumb of the hand the user is firing with, enabling ambidextrous use.

Said safety element (16) is configured to be placed, or activated, and removed, or deactivated, by the user, having the particularity that said safety element (16) is always automatically located in the active position when the bolt (8) is unlocked to load or unload the weapon, preventing in said active safety position the firing of the rifle.

Figure 2:
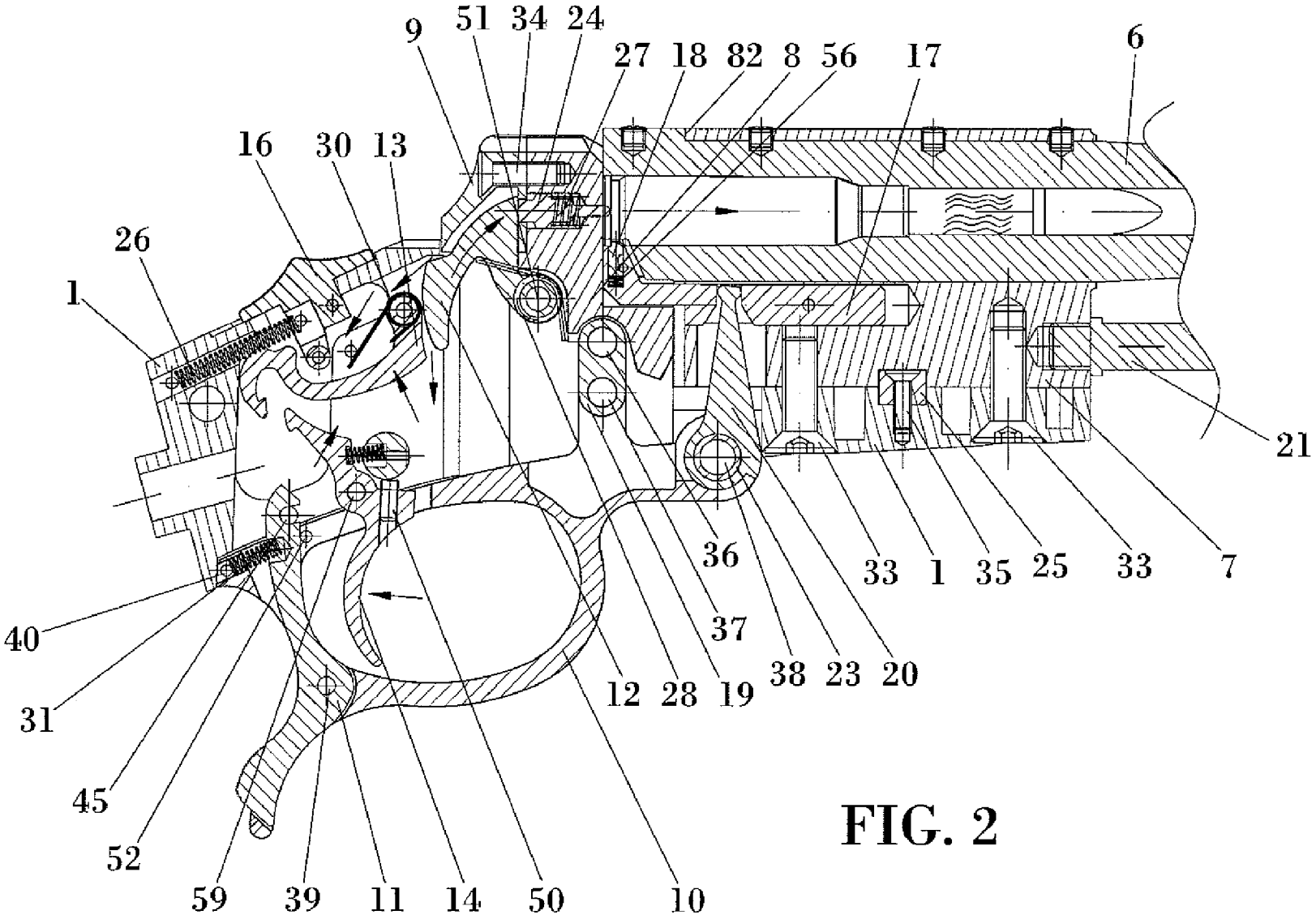
FIG. 2 shows a longitudinal section of the action mechanism of the rifle in the position at the moment of firing, in which the flow of gases in the area corresponding to the fire protection element has been shown with arrows.
Figure 3:
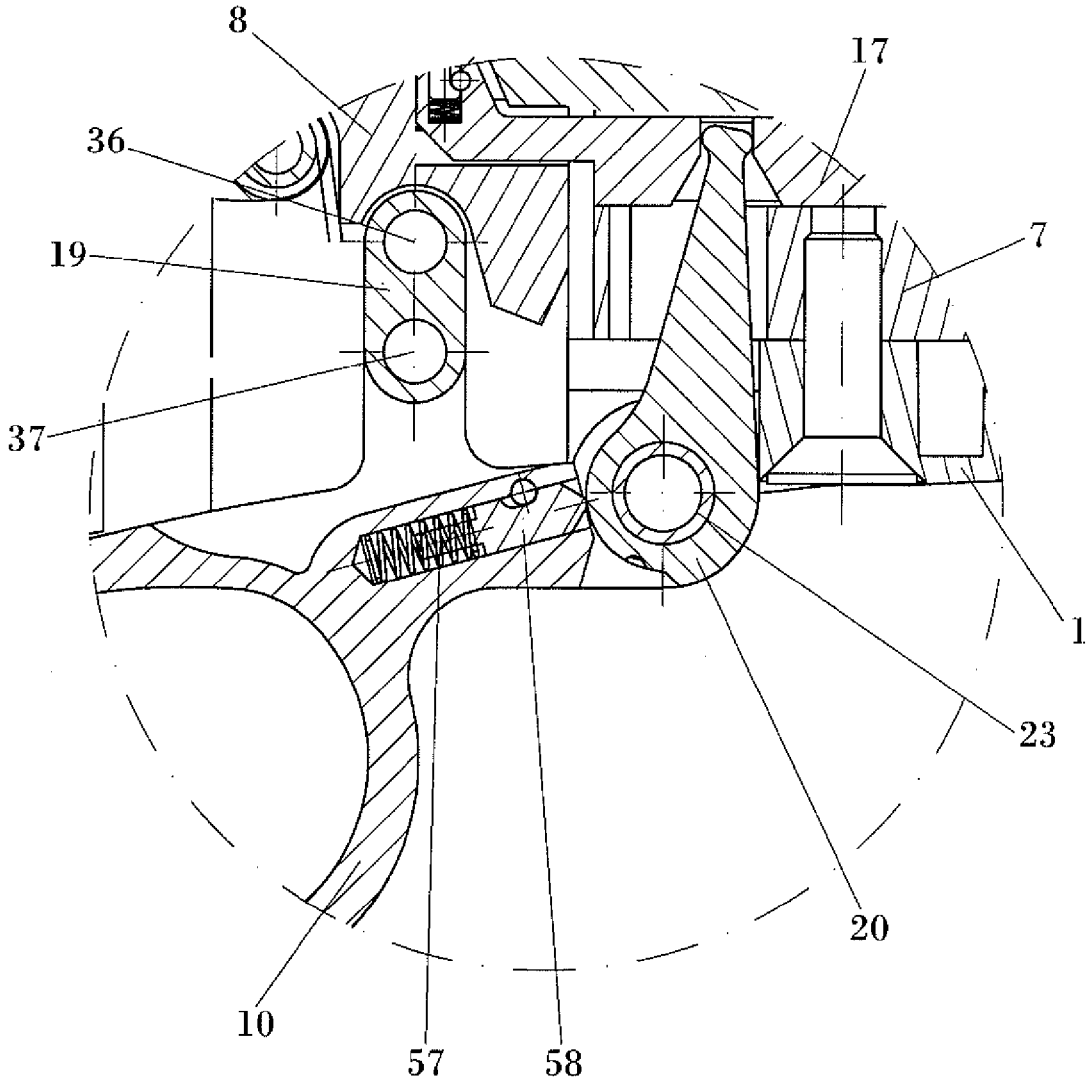
FIG. 3 shows a detail of the previous figure corresponding to the lever and the pivotable arm.
Figure 4:
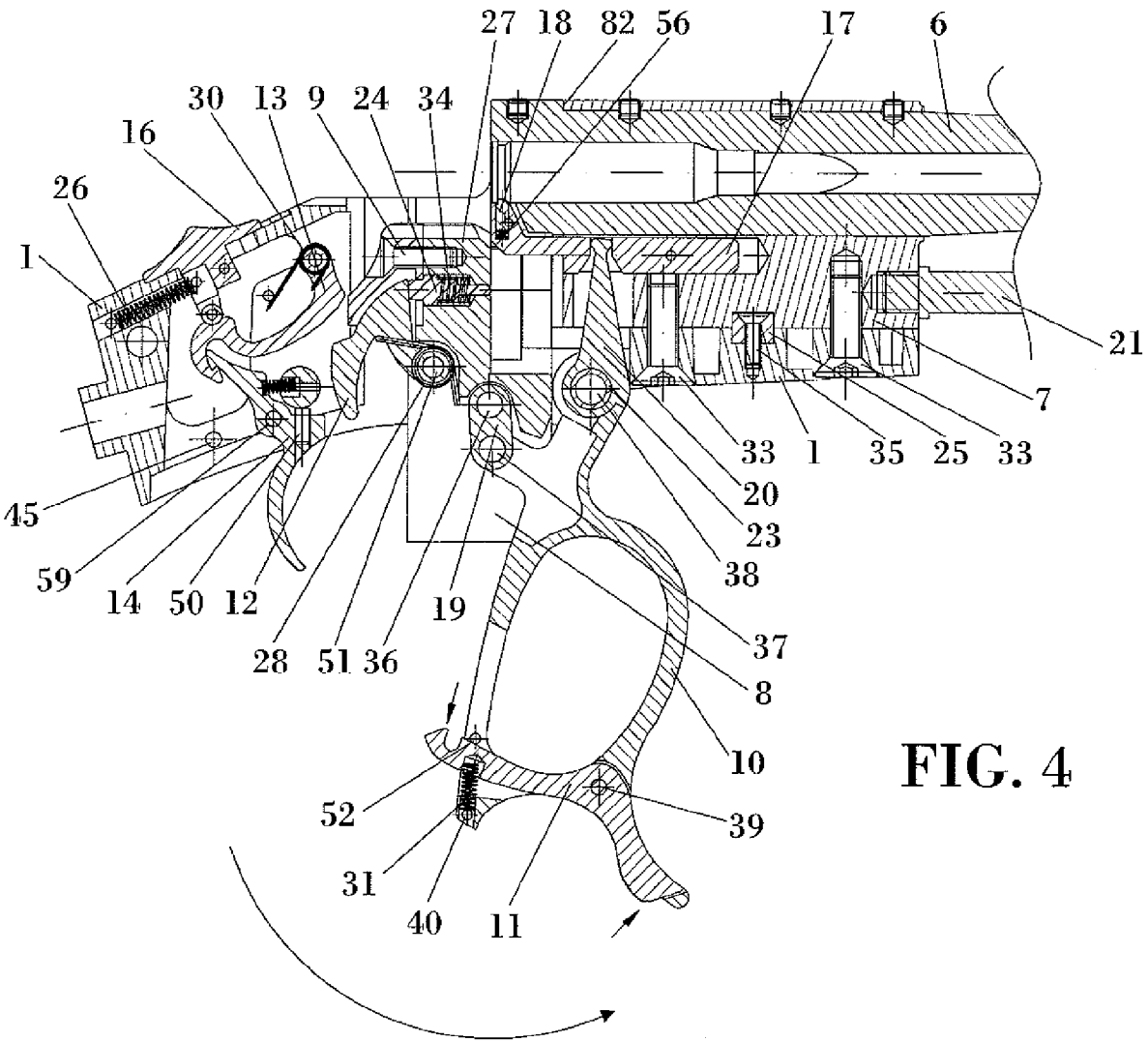
FIG. 4 shows a longitudinal section of the action mechanism of the rifle in a first extraction position.
Figure 5:
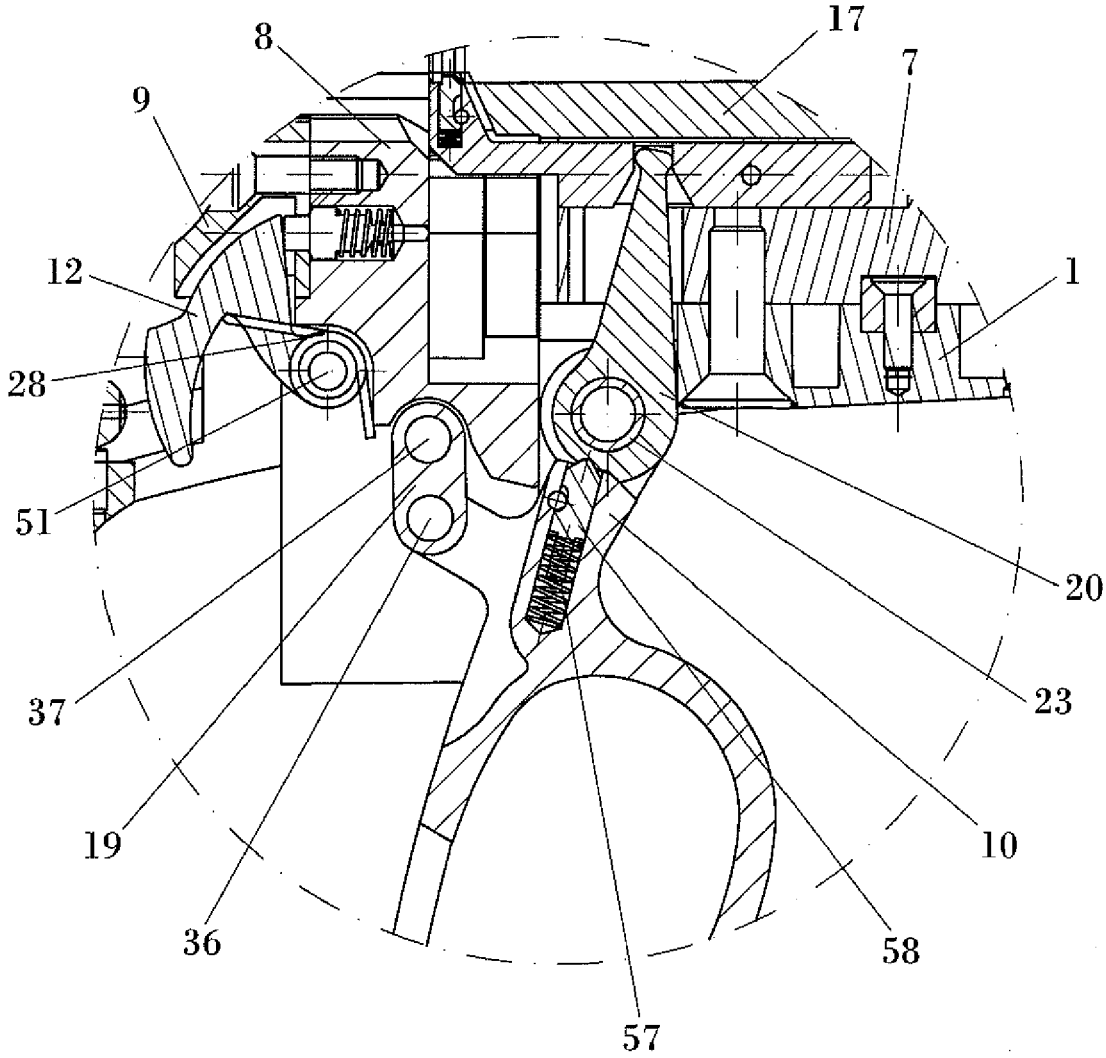
FIG. 5 shows a detail of the previous figure corresponding to the lever and the pivotable arm.
Figure 9:
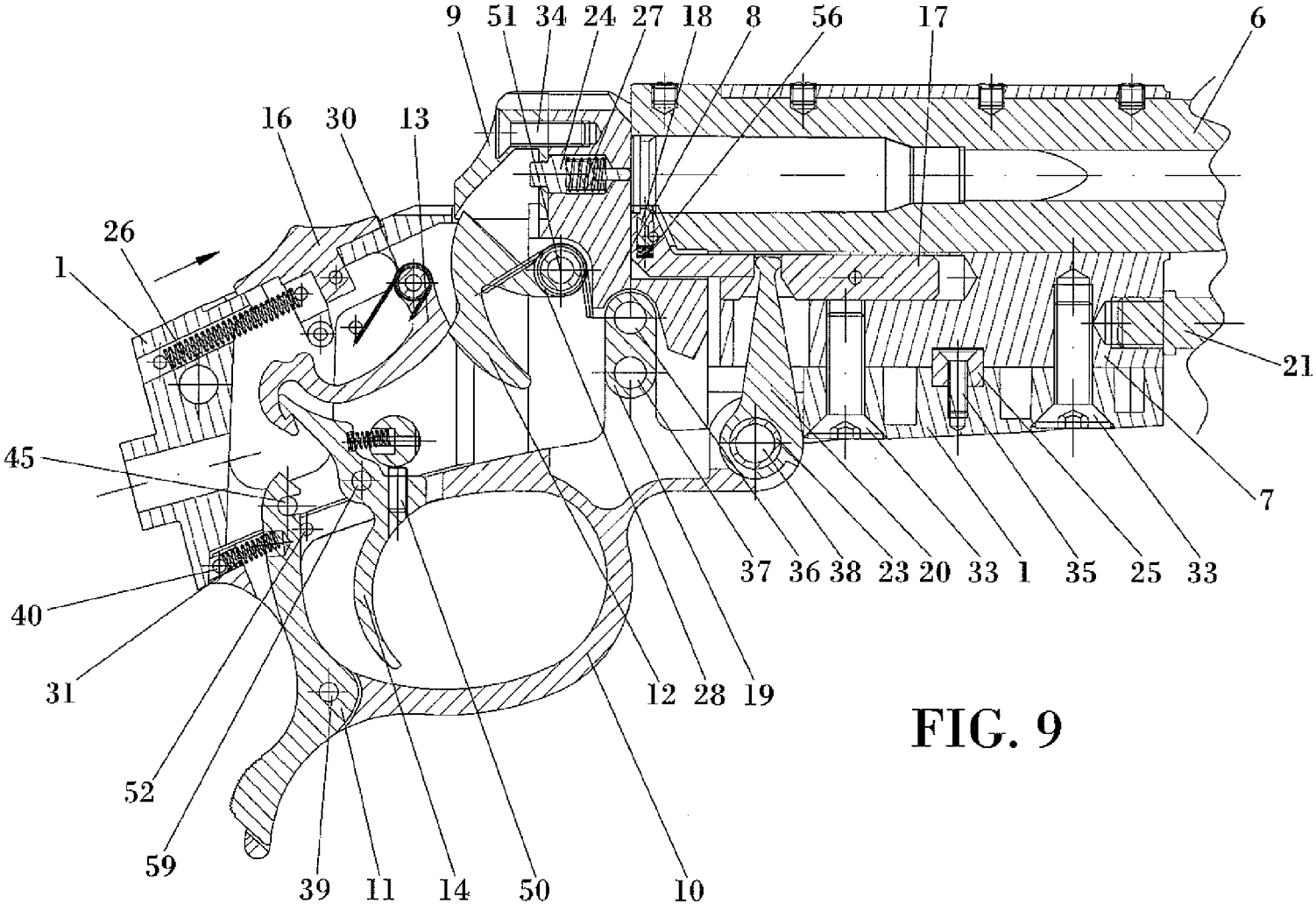
FIG. 9 shows a section like that of the previous figure in the same position, in which the safety is inactive.

For the rifle to meet optimal conditions, it is necessary to arrange said safety element (16), since the rifle automatically charges the hammer (12) when the lever (10) moves up. To that end, the safety element (16) has a safety spring (26) which pulls on said safety element (16) as soon as the sear element (13) is released from the hammer (12), i.e. when the lever (10) is lowered. Therefore, when said lever (10) moves up for the purpose of compressing the percussion spring (27), the safety element (16) is already acting, i.e. it is already activated, as can be seen in FIGS. 6 and 8. In short, in order to fire it is always necessary for the user to voluntarily remove the safety, placing it in the inactive position, as shown in FIGS. 9 and 2.

According to a preferred embodiment, the rifle comprises a highly sensitive trigger (14) provided with dual-regulation. To that end, the lower part of the trigger (14) has an adjusting screw (50) which, by means of tightening it, achieves that the trigger (14) recoils, therefore the engagement of the upper area with the sear element (13) is reduced, and therefore the trigger is attenuated.

Once the firing has been performed, the rifle has the end stop adjusting screw (59), which runs inside the trigger spring, which decreases or reduces the run of the trigger (14) by means of tightening it.

Likewise, the sear element (13) is arranged such that when the bolt (8) travels towards its loading position, the sear element (13) engages with the trigger (14).

The rifle comprises a hammer (12) configured to strike the firing pin (24) when the trigger (14) is squeezed with the safety element (16) in the position in which it does not prevent the firing of the rifle, the hammer (12) being pivotably attached to the bolt (8) such that it travels with the bolt (8) when the bolt (8) travels between the firing position and the loading position.

When the sear element (13) drops down, it contacts or engages with the trigger (14). When the bolt (8) is raised, the hammer (12) contained in said bolt (8) is retained by the sear element (13), the rifled being in a cocked position, which is shown in FIG. 9.

The hammer (12) is located inside the bolt (8) and is configured to strike the firing pin (24), such that said firing pin (24) in turn acts on an ammunition percussion cap causing its detonation.

The hammer (12) is linked to the sear element (13) such that is retained by the sear element (13) when the bolt (8) travels from the loading position towards the firing position, such that when the bolt (8) reaches the firing position, the hammer (12) is cocked to be fired towards the firing pin (24).

The single-shot rifle of the invention also comprises a fire protection element (9) associated to the bolt (8) and configured to deflect sparks coming out backwards at the moment of firing.

The bolt (8) is locked with the fire protection element (9), also referred to as safety deflector, consisting of a steel part which is fastened to the bolt (8) by a screw (34). The bolt (8) internally has the hammer (12) which is configured to rotate with regard to an axis (51) of hammer (12) and to be actuated by a main spring (28) as can be seen, for example, in FIG. 2.

Occasionally, as a result of ammunition defects or overlapping, the firing pin (24) perforates the primer when firing, causing a high-pressure backfire towards the shooter through the firing pin passage, specifically towards the shooter's face and eyes, with the subsequent risk of a serious accident that this entails.

For the purpose of increasing the safety of the rifle, by means of eliminating the effect described in the preceding paragraph, the rifle proposed by the invention comprises a fire protection element (9), i.e. a safety deflector consisting of a steel part firmly fastened to the bolt (8), said fire protection element (9) being configured to deflect the backfire occurring when firing towards inner areas, with lower exhaust, of the receiver (1), making said bolt (8) lose pressure and thus preventing the previously discussed accidents.

According to a preferred embodiment of the invention, the fire protection element (9) comprises a deflection surface, configured to deflect sparks towards the inside of the receiver (1), preventing them from reaching the user's eyes. Said deflection surface is preferably configured such that it forms, in the vertical plane traversing the barrel (6) when the rifle is in a conventional use position, an angle of approximately 45 degrees with the longitudinal direction in which the barrel (6) extends.

To that end, as can be seen in FIGS. 2 and 9, for example, the fire protection element (9) comprises an inclined plane, preferably occupying a 45° inclination when the rifle is in a firing position, which is located opposite to the passage of the firing pin (24), such that by means of this arrangement the sparks bounce off and are guided downwards, avoiding striking the face of the user of the rifle.

In view of this description and set of drawings, a person skilled in the art may understand that the embodiments of the invention that have been described can be combined in many ways within the object of the invention. The invention has been described according to several preferred embodiments thereof, but it will be obvious for a person skilled in the art that many variations can be introduced in said preferred embodiments without exceeding the object of the claimed invention.

The invention claimed is:

1. A single-shot rifle, comprising:

a receiver;

a longitudinally extending barrel and having a front end and a back end, the barrel being attached to the receiver;

a bolt housing a firing pin, the bolt being located in correspondence with the back end of the barrel;

wherein the bolt and the back end of the barrel are configured such that the bolt can be coupled to the back end of the barrel by a sliding movement in a direction substantially perpendicular to said longitudinally extending barrel, such that the bolt can travel, by said sliding movement, between a loading position in which said bolt leaves the back end of the barrel clear such that a user can insert a cartridge in a chamber of the barrel through said back end of the barrel, and a firing position in which said chamber is locked by said bolt, the barrel and the bolt being directly coupled by at least one rib entering in at least one channel, such that said sliding movement is enabled and such that the bolt is prevented from traveling backwards with regard to the back end of the barrel and wherein said at least one rib extends around at least part of the circumference of the barrel, in correspondence with the back end of the barrel.

2. A single-shot rifle according to claim 1, wherein said at least one rib comprises at least one rib located in the back end of the barrel, and wherein said at least one channel comprises at least one channel located in the bolt and configured to receive said at least one rib, such that with said at least one rib housed in said at least one channel the bolt is attached to the barrel such that said bolt cannot travel backwards with regard to the barrel, but such that said bolt can travel in a direction substantially perpendicular to the barrel, by sliding said at least one rib in said at least one channel.

3. A single-shot rifle according to claim 1, wherein said at least one rib comprises at least two ribs, and wherein said at least one channel comprises at least two channels.

4. A single-shot rifle according to claim 1, wherein the barrel, in correspondence with its back part, is provided with a solid element for fixing the barrel to the receiver.

5. A single-shot rifle according to claim 4, wherein the barrel, in correspondence with its back end, comprises at least one flange, configured to be used as a stop limiting the position of the solid element, said barrel being configured to be frontally introduced in said solid element.

6. A single-shot rifle according to claim 4, wherein the solid element has holes for the attachment between the barrel and the receiver by screws which are threaded in said holes.

7. A single-shot rifle according to claim 1, additionally comprising at least one lever pivotable about an axis, said lever being coupled to the bolt such that when the lever pivots in a first direction, said lever moves the bolt towards the loading position, and when the lever pivots in a second direction opposite to the first direction, the lever moves the bolt towards the firing position.

8. A single-shot rifle according to claim 7, wherein said lever is coupled to the bolt by an attachment element pivotably coupled to the bolt and also pivotably coupled to the lever.

9. A single-shot rifle according to claim 7, wherein said lever is associated to an extractor configured for extracting the cartridge cases, such that when said lever pivots in said first direction, said lever makes said extractor slide backwards so that said extractor causes the extraction of a cartridge case.

10. A single-shot rifle according to claim 9, wherein said lever is associated to said extractor by a pivotable arm meshing with the extractor and being configured such that said pivotable arm follows the movement of the lever during at least part of the run of the lever between the loading position and the firing position of the bolt.

11. A single-shot rifle according to claim 9, wherein the extractor is provided with a pin pressed on by a spring, said pin being configured to slide in a groove in the barrel during at least part of the run of the extractor, and to mesh with a used cartridge case for its extraction from the chamber.

12. A single-shot rifle according to claim 1, additionally comprising a fire protection element associated to the bolt and configured to deflect sparks coming out backwards at the moment of firing.

13. A single-shot rifle according to claim 12, wherein said fire protection element comprises a deflection surface configured to deflect sparks towards the inside of the receiver, preventing them from reaching the user's eyes.

14. A single-shot rifle according to claim 13, said deflection surface being configured such that said surface forms, in the vertical plane traversing the barrel, an angle of approximately 45 degrees along a longitudinal direction in which the barrel extends.

15. A single-shot rifle comprising:

a receiver;

a longitudinally extending barrel and having a front end and a back end, the barrel being attached to the receiver;

a bolt housing a firing pin, the bolt being located in correspondence with the back end of the barrel;

wherein the bolt and the back end of the barrel are configured such that the bolt can be coupled to the back end of the barrel by a sliding movement in a direction substantially perpendicular to said longitudinally extending barrel, such that the bolt can travel, by said sliding movement, between a loading position in which said bolt leaves the back end of the barrel clear such that a user can insert a cartridge in a chamber of the barrel through said back end of the barrel, and a firing position in which said chamber is locked by said bolt, the barrel and the bolt being attached by at least one rib entering in at least one channel, such that said sliding movement is enabled and such that the bolt is prevented from traveling backwards with regard to the back end of the barrel;

wherein the barrel, in correspondence with its back part, is provided with a solid element for fixing the barrel to the receiver; and additionally comprising a handguard attached to the barrel by a pin threaded in the solid element and substantially extending parallel to the barrel, the pin having a substantially conical surface which is introduced in a clip in which the pin is held by a screw.

16. A single-shot rifle comprising:

a receiver;

a longitudinally extending barrel and having a front end and a back end, the barrel being attached to the receiver;

a bolt housing a firing pin, the bolt being located in correspondence with the back end of the barrel;

wherein the bolt and the back end of the barrel are configured such that the bolt can be coupled to the back end of the barrel by a sliding movement in a direction substantially perpendicular to said longitudinally extending barrel, such that the bolt can travel, by said sliding movement, between a loading position in which said bolt leaves the back end of the barrel clear such that a user can insert a cartridge in a chamber of the barrel through said back end of the barrel, and a firing position in which said chamber is locked by said bolt, the barrel and the bolt being attached by at least one rib entering in at least one channel, such that said sliding movement is enabled and such that the bolt is prevented from traveling backwards with regard to the back end of the barrel; and further comprising a sear element pushed by a sear spring towards a position in which said sear element engages a trigger, as well as a safety element that can travel between a position in which said safety element prevents the firing of the rifle and another position in which said safety element does not prevent the firing of the rifle, the safety element being drawn towards the position in which said safety element prevents the firing of the rifle by a safety spring, the safety element and the sear element being arranged such that when the bolt travels towards the loading position, the sear element pushed by the sear spring travels, allowing the safety element to travel to the position in which it prevents the firing of the rifle.

17. A single-shot rifle according to claim 16, wherein the sear element is arranged such that when the bolt travels towards its loading position, the sear element engages with the trigger.

18. A single-shot rifle according to claim 17, additionally comprising a hammer configured to strike the firing pin when the trigger is squeezed with the safety element in the position in which said safety element does not prevent the firing of the rifle, the hammer being pivotably attached to the bolt such that said hammer travels with the bolt when the bolt travels between the firing position and the loading position.

19. A single-shot rifle according to claim 18, wherein the hammer is connected to the sear element such that said hammer is retained by the sear element when the bolt travels from the loading position towards the firing position, such that when the bolt reaches the firing position, the hammer is cocked to be fired towards the firing pin.

* * * * *